US010755666B2

(12) United States Patent
Marchya et al.

(10) Patent No.: US 10,755,666 B2
(45) Date of Patent: Aug. 25, 2020

(54) CONTENT REFRESH ON A DISPLAY WITH HYBRID REFRESH MODE

(71) Applicant: QUALCOMM Incorporated, San Diego, CA (US)

(72) Inventors: Dileep Marchya, Hyderabad (IN); Balamukund Sripada, Hyderabad (IN)

(73) Assignee: QUALCOMM Incorporated, San Diego, CA (US)

( * ) Notice: Subject to any disclaimer, the term of this patent is extended or adjusted under 35 U.S.C. 154(b) by 0 days.

(21) Appl. No.: 16/048,098

(22) Filed: Jul. 27, 2018

(65) Prior Publication Data

US 2020/0035192 A1 Jan. 30, 2020

(51) Int. Cl.
*G09G 5/00* (2006.01)

(52) U.S. Cl.
CPC ..... *G09G 5/001* (2013.01); *G09G 5/003* (2013.01); *G09G 2320/0252* (2013.01); *G09G 2320/103* (2013.01); *G09G 2340/0435* (2013.01); *G09G 2360/02* (2013.01); *G09G 2360/18* (2013.01)

(58) Field of Classification Search
CPC ..... G09G 5/001; G09G 5/003; G09G 2340/0435; G09G 2320/0252; G09G 2360/18; G09G 2360/02; G09G 2320/103; G09G 2310/04; G09G 2370/16; G09G 3/20
See application file for complete search history.

(56) References Cited

U.S. PATENT DOCUMENTS

| | | | | |
|---|---|---|---|---|
| 9,524,008 | B1 | 12/2016 | Woodall et al. | |
| 2012/0162238 | A1 | 6/2012 | Fleck et al. | |
| 2014/0327630 | A1 | 11/2014 | Burr et al. | |
| 2015/0187340 | A1 | 7/2015 | Ozawa | |
| 2016/0180796 | A1 | 6/2016 | Morein | |
| 2016/0189688 | A1* | 6/2016 | Morein | G09G 5/39 345/545 |
| 2019/0087144 | A1* | 3/2019 | Yadav | G06F 3/147 |
| 2019/0089927 | A1* | 3/2019 | Yadav | H04N 5/92 |

* cited by examiner

*Primary Examiner* — Robert J Craddock
(74) *Attorney, Agent, or Firm* — Arent Fox, LLP

(57) ABSTRACT

A method, an apparatus, and a computer-readable medium for wireless communication are provided. In one aspect, an example method may include causing a first region of a display to be refreshed without using a memory of the display, and causing a second region of the display to be refreshed using the memory of the display.

24 Claims, 5 Drawing Sheets

CONTENT REFRESH ON A DISPLAY WITH HYBRID REFRESH MODE

FIELD

The present disclosure relates generally relates to refreshing content on a display.

BACKGROUND

Computing devices often utilize a graphics processing unit (GPU) to accelerate the rendering of graphical data for display. Such computing devices may include, for example, computer workstations, mobile phones such as so-called smartphones, embedded systems, personal computers, tablet computers, and video game consoles. GPUs execute a graphics processing pipeline that includes a plurality of processing stages that operate together to execute graphics processing commands/instructions and output a frame. A central processing unit (CPU) may control the operation of the GPU by issuing one or more graphics processing commands/instructions to the GPU. Modern day CPUs are typically capable of concurrently executing multiple applications, each of which may need to utilize the GPU during execution. A device that provides content for visual presentation on a display generally includes a graphics processing unit (GPU).

A GPU renders a frame of graphical content into a framebuffer for display. This rendered frame may be read from the framebuffer and processed by a display processing unit prior to being displayed. For example, the display processing unit may be configured to perform processing on one or more frames that were rendered for display by the GPU and subsequently output the processed frame to a display. The pipeline that includes the CPU, GPU, and display processing unit may be referred to as a display processing pipeline. In addition to receiving content generated by a GPU, a display processing unit may receive content generated by another component, such as a video decoder, camera, or any other component configured to provide content for display.

SUMMARY

The following presents a simplified summary of one or more aspects in order to provide a basic understanding of such aspects. This summary is not an extensive overview of all contemplated aspects, and is intended to neither identify key or critical elements of all aspects nor delineate the scope of any or all aspects. Its sole purpose is to present some concepts of one or more aspects in a simplified form as a prelude to the more detailed description that is presented later.

In an aspect of the disclosure, a method, a computer-readable medium, and an apparatus are provided. The apparatus may be configured to cause a first region of a display to be refreshed without using a memory of the display, and cause a second region of the display to be refreshed using the memory of the display.

The details of one or more examples of the disclosure are set forth in the accompanying drawings and the description below. Other features, objects, and advantages of the disclosure will be apparent from the description and drawings, and from the claims.

DETAILED DESCRIPTION

Figure 1A:
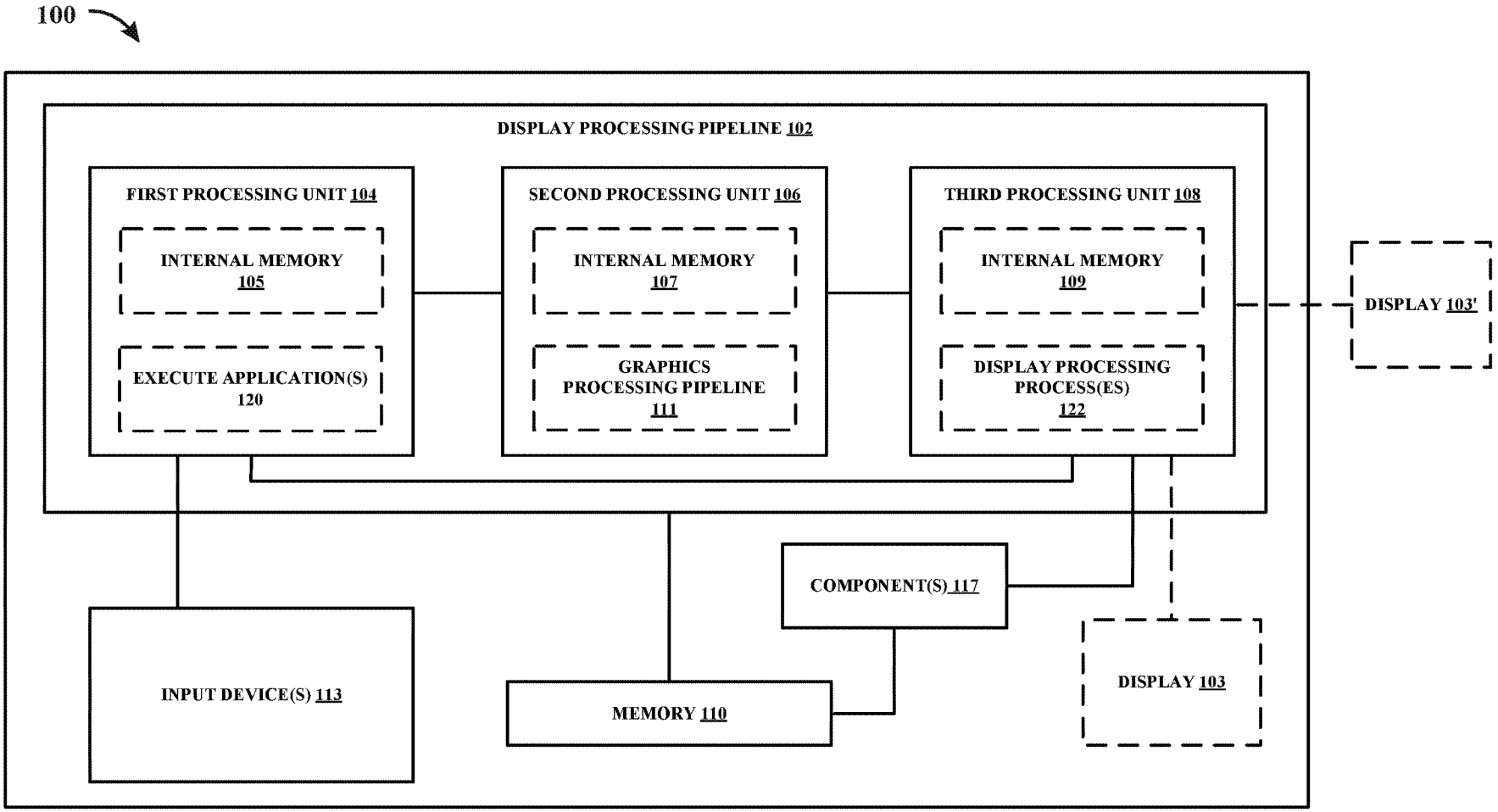
FIG. 1A is a block diagram that illustrates an example device in accordance with the techniques of this disclosure.

Various aspects of systems, apparatuses, computer program products, and methods are described more fully hereinafter with reference to the accompanying drawings. This disclosure may, however, be embodied in many different forms and should not be construed as limited to any specific structure or function presented throughout this disclosure. Rather, these aspects are provided so that this disclosure will be thorough and complete, and will fully convey the scope of this disclosure to those skilled in the art. Based on the teachings herein one skilled in the art should appreciate that the scope of this disclosure is intended to cover any aspect of the systems, apparatuses, computer program products, and methods disclosed herein, whether implemented independently of, or combined with, other aspect of the disclosure. For example, an apparatus may be implemented or a method may be practiced using any number of the aspects set forth herein. In addition, the scope of the disclosure is intended to cover such an apparatus or method which is practiced using other structure, functionality, or structure and functionality in addition to or other than the various aspects of the disclosure set forth herein. Any aspect disclosed herein may be embodied by one or more elements of a claim.

Although various aspects are described herein, many variations and permutations of these aspects fall within the scope of this disclosure. Although some potential benefits and advantages of aspects of this disclosure are mentioned, the scope of this disclosure is not intended to be limited to particular benefits, uses, or objectives. Rather, aspects of this disclosure are intended to be broadly applicable to different wireless technologies, system configurations, networks, and transmission protocols, some of which are illustrated by way of example in the figures and in the following description. The detailed description and drawings are merely illustrative of this disclosure rather than limiting, the scope of this disclosure being defined by the appended claims and equivalents thereof.

Several aspects are presented with reference to various apparatus and methods. These apparatus and methods are described in the following detailed description and illustrated in the accompanying drawings by various blocks, components, circuits, processes, algorithms, and the like (collectively referred to as "elements"). These elements may be implemented using electronic hardware, computer software, or any combination thereof. Whether such elements are implemented as hardware or software depends upon the particular application and design constraints imposed on the overall system.

By way of example, an element, or any portion of an element, or any combination of elements may be implemented as a "processing system" that includes one or more processors (which may also be referred to as processing units). Examples of processors include microprocessors, microcontrollers, graphics processing units (GPUs), general purpose GPUs (GPGPUs), central processing units (CPUs), application processors, digital signal processors (DSPs), reduced instruction set computing (RISC) processors, systems on a chip (SoC), baseband processors, application specific integrated circuits (ASICs), field programmable gate arrays (FPGAs), programmable logic devices (PLDs), state machines, gated logic, discrete hardware circuits, and other suitable hardware configured to perform the various functionality described throughout this disclosure. One or more processors in the processing system may execute software. Software shall be construed broadly to mean instructions, instruction sets, code, code segments, program code, programs, subprograms, software components, applications, software applications, software packages, routines, subroutines, objects, executables, threads of execution, procedures, functions, etc., whether referred to as software, firmware, middleware, microcode, hardware description language, or otherwise. The term application may refer to software. As described herein, one or more techniques may refer to an application (i.e., software) being configured to perform one or more functions. In such examples, it is understood that the application may be stored on a memory (e.g., on-chip memory of a processor, system memory, or any other memory). Hardware described herein, such as a processor may be configured to execute the application. For example, the application may be described as including code that, when executed by the hardware, causes the hardware to perform one or more techniques described herein. As an example, the hardware may access the code from a memory and executed the code accessed from the memory to perform one or more techniques described herein. In some examples, components are identified in this disclosure. In such examples, the components may be hardware, software, or a combination thereof. The components may be separate components or sub-components of a single component.

Accordingly, in one or more examples described herein, the functions described may be implemented in hardware, software, or any combination thereof. If implemented in software, the functions may be stored on or encoded as one or more instructions or code on a computer-readable medium. Computer-readable media includes computer storage media. Storage media may be any available media that can be accessed by a computer. By way of example, and not limitation, such computer-readable media can comprise a random-access memory (RAM), a read-only memory (ROM), an electrically erasable programmable ROM (EEPROM), optical disk storage, magnetic disk storage, other magnetic storage devices, combinations of the aforementioned types of computer-readable media, or any other medium that can be used to store computer executable code in the form of instructions or data structures that can be accessed by a computer.

In some examples, as used herein, instances of the term "content" may refer to content generated by a component of the device 100 (e.g., the first processing unit 104, the second processing unit 106, one or more input devices 113, or one or more other components 117 (e.g., a video decoder or a camera)), which may be referred to as "generated content." For example, the second processing unit 106 may be configured to generate graphical content. As another example, a video decoder (i.e., one example of the one or more components 117) may be configured to receive encoded video content, and subsequently decode the encoded video content to generate video content. In other examples, the term "content" may refer to display content. In some examples, as used herein, the term "display content" may refer to content generated by a processing unit configured to perform displaying processing. In some examples, as used herein, the term "display content" may refer to content generated by a display processing unit. Content generated by a component of the device 100 may be processed to become display content. For example, a graphics processing unit may output graphical content, such as a frame, to a buffer (which may be referred to as a framebuffer). A display processing unit may read the graphical content, such as one or more frames from the buffer, and perform one or more display processing techniques thereon to generate display content. For example, a display processing unit may be configured to perform composition on one or more rendered layers to generate a frame for display. As another example, a display processing unit may be configured to compose, blend, or otherwise combine two or more layers together into a single frame. A display processing unit may be configured to perform scaling (e.g., upscaling or downscaling) on a frame. In some examples, a frame may refer to a layer. In other examples, a frame may refer to two or more layers that have already been blended together to form the frame (i.e., the frame includes two or more layers, and the frame that includes two or more layers may subsequently be blended). In some examples, a display processing unit may receive generated content and not perform any processing thereon. In such examples, the content output by the display processing unit may be the same as the content received by the display processing unit.

In some examples, as used herein, a display processing unit may be configured to receive content and output content. The content received by the display processing unit may be referred to as "generated content," which may be content that generated by a component of the device 100. The display processing unit may be configured to read the generated content from a memory. The content output by the display processing unit may be referred to as "display content," which is provided to a display for presentment thereon.

As referenced herein, a first component (e.g., a GPU) may provide content, such as a frame, to a second component (e.g., a display processing unit). In some examples, the first component may provide content to the second component by storing the content in a memory accessible to the second component. In such examples, the second component may be configured to read the content stored in the memory by the first component. In other examples, the first component may provide content to the second component without any intermediary components (e.g., without memory or another component). In such examples, the first component may be described as providing content directly to the second component. For example, the first component may output the content to the second component, and the second component may be configured to store the content received from the first component in a memory, such as a buffer.

FIG. 1A is a block diagram that illustrates an example device 100 configured to perform one or more techniques of this disclosure. The device 100 includes one or more components configured to perform one or more technique of this disclosure. The device 100 may include a first processing unit 104, a second processing unit 106, a third processing unit 108, one or more input devices 113, and one or more other components 117. In some examples, the first processing unit 104, the second processing unit 106, and the third processing unit 108 may make up a display processing pipeline 102.

The third processing unit 108 may be communicatively coupled to a display 103. In the example of FIG. 1A, the display 103 is a display of the device 100. However, in other examples, the display 103 may be a display external to the device 100 (as shown in FIG. 1 with display 103'). Reference to display 103 in the specification or the drawings may refer to display 103 or display 103' (i.e., a display of the device or a display external to the device). In accordance with the techniques described herein, the third processing unit 108 may be configured to output or otherwise provide content to the display 103.

In examples where the display 103 is not external to the device 100, the third processing unit 108 may be configured to transmit or otherwise provide commands and/or content to the display 103 for presentment thereon. In examples where the display 103 is external to the device 100, the device 100 may be configured to transmit or otherwise provide commands and/or content to the display 103 for presentment thereon. As used herein, "commands," "instructions," and "code" may be used interchangeably. In some examples, the display 103 of the device 100 may represent a display projector configured to project content, such as onto a viewing medium (e.g., a screen, a wall, or any other viewing medium). In some examples, the display 103 may include one or more of: a liquid crystal display (LCD), a plasma display, an organic light emitting diode (OLED) display, a projection display device, an augmented reality (AR) display device, a virtual reality (VR) display device, a head-mounted display, a wearable display, or any other type of display. In some examples, a display may be referred to as a display panel.

In some examples, the display 103 represents a first display and a second display, where the first display is for presenting display content for a left eye of a user and the second display is for presenting display content for a right eye of a user. In such examples, the first display and the second display may be respectively referred to as a left eye display and a right eye display. In some examples, the display 103 may be a command mode display. The display 103 may be configured to operate in one or more modes of operation.

In some examples, the first processing unit 104 may be configured to execute one or more applications 120, the second processing unit 106 may be configured to perform graphics processing, and the third processing unit 108 may be configured to perform display processing. In such examples, the first processing unit 104 may be a central processing unit (CPU), the second processing unit 106 may be a graphics processing unit (GPU) or a general purpose GPU (GPGPU), and the third processing unit 108 may be a display processing unit, which may also be referred to as a display processor. In other examples, the first processing unit 104, the second processing unit 106, and the third processing unit 108 may each be any processing unit configured to perform one or more feature described with respect to each processing unit.

The first processing unit may include an internal memory 105. The second processing unit 106 may include an internal memory 107. In some examples, the internal memory 107 may be referred to as a GMEM. The third processing unit 108 may include an internal memory 109. One or more of the processing units 104, 106, and 108 of the display processing pipeline 102 may be communicatively coupled to a memory 110. The memory 110 may be external to the one or more of the processing units 104, 106, and 108 of the display processing pipeline 102. For example, the memory 110 may be a system memory. The system memory may be a system memory of the device 100 that is accessible by one or more components of the device 100. For example, the first processing unit 104 may be configured to read from and/or write to the memory 110. The second processing unit 106 may be configured to read from and/or write to the memory 110. The third processing unit 108 may be configured to read from and/or write to the memory 110. The first processing unit 104, the second processing unit 106, and the third processing unit 108 may be communicatively coupled to the memory 110 over a bus. In some examples, the one or more components of the display processing pipeline 102 may be communicatively coupled to each other over the bus or a different connection. In other examples, the system memory may be a memory external to the device 100.

The internal memory 105, the internal memory 107, the internal memory 109, and/or the memory 110 may include one or more volatile or non-volatile memories or storage devices. In some examples, the internal memory 105, the internal memory 107, the internal memory 109, and/or the memory 110 may include random access memory (RAM), static RAM (SRAM), dynamic RAM (DRAM), erasable programmable ROM (EPROM), electrically erasable programmable ROM (EEPROM), Flash memory, a magnetic data media or an optical storage media, or any other type of memory.

The internal memory 105, the internal memory 107, the internal memory 109, and/or the memory 110 may be a non-transitory storage medium according to some examples. The term "non-transitory" may indicate that the storage medium is not embodied in a carrier wave or a propagated signal. However, the term "non-transitory" should not be interpreted to mean that the internal memory 105, the internal memory 107, the internal memory 109, and/or the memory 110 is non-movable or that its contents are static. As one example, the memory 110 may be removed from the device 100 and moved to another device. As another example, the memory 110 may not be removable from the device 100.

In some examples, the first processing unit 104 may be configured to perform any technique described herein with respect to the second processing unit 106. In such examples, the display processing pipeline 102 may only include the first processing unit 104 and the third processing unit 108. Alternatively, the display processing pipeline 102 may still include the second processing unit 106, but one or more of the techniques described herein with respect to the second processing unit 106 may instead be performed by the first processing unit 104.

In some examples, the first processing unit 104 may be configured to perform any technique described herein with respect to the third processing unit 108. In such examples, the display processing pipeline 102 may only include the first processing unit 104 and the second processing unit 106. Alternatively, the display processing pipeline 102 may still include the third processing unit 108, but one or more of the techniques described herein with respect to the third processing unit 108 may instead be performed by the first processing unit 104.

In some examples, the second processing unit 106 may be configured to perform any technique described herein with respect to the third processing unit 108. In such examples, the display processing pipeline 102 may only include the first processing unit 104 and the second processing unit 106. Alternatively, the display processing pipeline 102 may still include the third processing unit 108, but one or more of the techniques described herein with respect to the third processing unit 108 may instead be performed by the second processing unit 106.

The first processing unit 104 may be configured to execute one or more applications 120. The first processing unit 104 may be configured to provide one or more commands/instructions (e.g., draw instructions) to the second processing unit 106 to cause the second processing unit 106 to generate graphical content. As used herein, "commands," "instructions," and "code" may be used interchangeably. For example, execution of an application of the one or more applications 120 may cause one or more commands/instructions (e.g., draw instructions) corresponding to the application to be provided to the second processing unit 106 to generate graphical content for the application. In some examples, an application may be software (e.g., code) stored in the internal memory 105. In other examples, an application may be software stored in the memory 110 or another memory accessible to the first processing unit 104. In other examples, an application may be software stored in a plurality of memories, such as the internal memory 105 and the memory 110.

The second processing unit 106 may be configured to perform graphics processing in accordance with the techniques described herein, such as in a graphics processing pipeline 111. Otherwise described, the second processing unit 106 may be configured to perform any process described herein with respect to the second processing unit 106.

The third processing unit 108 may be configured to perform one or more display processing processes 122 in accordance with the techniques described herein. For example, the third processing unit 108 may be configured to perform one or more display processing techniques on content received from one or more components of the device 100 (e.g., the first processing unit 104, the second processing unit 106, the one or more input devices 113, the one or more other components 117, or any other component of the device 100). Otherwise described, the third processing unit 108 may be configured to perform display processing on received content. In some examples, the one or more display processing processes 122 may include one or more of a rotation operation, a blending operation, a scaling operating, any display processing process/operation, or any process/operation described herein with respect to the third processing unit 108. In such examples, the third processing unit 108 may be configured to provide one or more instructions and the display content (e.g., processed, received content) to the display 103 in accordance with the techniques described herein. In other examples the third processing unit 108 may be configured to refrain from performing one or more display processing techniques on content received from one or more component of the device 100. In such examples, the third processing unit 108 may be configured to provide one or more instructions and the display content (e.g., unprocessed, received content) to the display 103 in accordance with the techniques described herein. In both of these examples, the one or more instructions provided to the display 103 may, when executed by a processing unit of the display 103, cause the processing unit of the display 103 to store content received from the third processing unit 108 in a memory of the display 103, or not store the content received from the third processing unit 108 in the memory of the display 103. In some examples, the third processing unit 108 may be configured to provide one or more instructions to the display 103 that, when executed by the processing unit of the display 103, causes the processing unit of the display to re-use previously stored content (e.g., read content previously stored in the memory) for display. Otherwise described, in some examples, the third processing unit 108 may be configured to provide content and one or more instructions corresponding to the content being provided to the display 103. In such examples, the one or more instructions may be referred to as one or more new content instructions. In other examples, the third processing unit 108 may be configured to provide one or more instructions corresponding to content that was previously provided to the display 103. In such examples, the one or more instructions may be referred to as one or more content re-use instructions.

The display 103 may be configured to display content that was received from the third processing unit 108 in accordance with the one or more instructions received corresponding to the content. As described above, the one or more instructions may be received from the third processing unit 108 with accompanying content (i.e., an example of the one or more new content instructions), or the one or more instructions may be received from the third processing unit 108 without being accompanied by content (i.e., an example of the one or more content re-use instructions) because the content was provided at a previous time with one or more new content instructions causing the display 103 to store the content in a memory of the display 103.

Figure 1B:
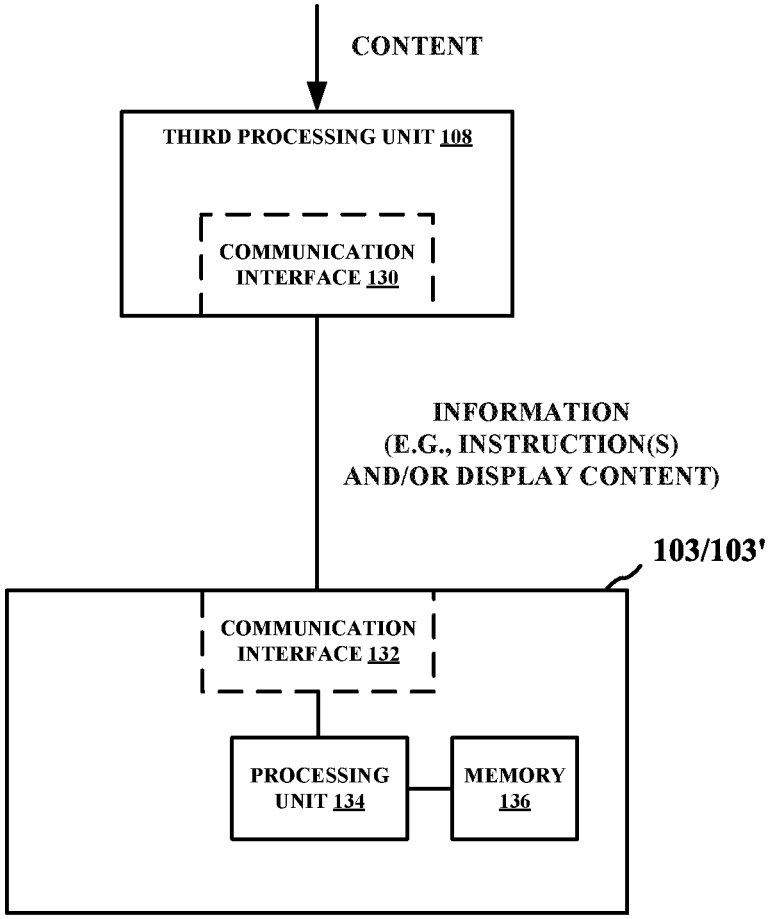
FIG. 1B is a block diagram that illustrates an example configuration between a component of the device depicted in FIG. 1A and a display.

FIG. 1B is a block diagram that illustrates an example configuration between the third processing unit 108 of the device 100 and the display 103. The example of display 103 in FIG. 1B is an example of a command mode display, which may also be referred to as a smart display. The display 103 may include a processing unit 134 and a memory 136 accessible by the processing unit 134. The processing unit 134 may be referred to as a display controller. The memory 136 may be configured to store data (e.g., content) that the display 103 receives from the third processing unit 108. For example, the memory 136 may be configured to store (e.g., buffer) content received from the third processing unit 108. In some examples, the memory 136 may have a size configured to store one or more frames of content. In such examples, the memory 136 may be referred to as a framebuffer. The processing unit 134 may be configured to read content stored in the memory 136 that was received from the third processing unit 108 and drive the display 103 based on one or more instructions received from the third processing unit 108.

The third processing unit 108 and the display 103 may be configured to communicate with each other over a communication medium (e.g., a wired and/or wireless communication medium). For example, the third processing unit 108 may include a communication interface 130 (e.g., a bus interface) and the display 103 may include a communication interface 132 (e.g., a bus interface) that enables communication between each other. In some examples, the third processing unit 108 may be configured to communicate information (e.g., content and/or one or more instructions) to the display 103. In such examples, the display 103 may be configured to receive the information provided by the third processing unit 108. In some examples, the display 103 may be configured to provide information (e.g., acknowledgement information and/or one or more instructions) to the third processing unit 108. In such examples, the third processing unit 108 may be configured to receive the information provided by the display 103. In some examples, the communication between the third processing unit 108 and the display 103 may be compliant with a communication standard, communication protocol, or the like. For example, the communication between the third processing unit 108 and the display 103 may be compliant with the Display Serial Interface (DSI) standard.

In some examples, one or more components of the device 100 may be combined into a single component. For example, one or more components of the device 100 may be one or more components of a system on chip (SoC). For example, one or more components of the display processing pipeline 102 may be one or more components of an SoC, in which case the display processing pipeline 102 may still include the first processing unit 104, the second processing unit 106, and the third processing unit 108; but as components of the SoC instead of physically separate components. In other examples, one or more components of the device 100 may be physically separate components that are not integrated into a single component. For example, the first processing unit 104, the second processing unit 106, and the third processing unit 108 may each be a physically separate component from each other. It is appreciated that the component layout of a device may have different configurations. As such, the techniques described herein are not limited to the illustrated configurations.

In some examples, one or more components of the display processing pipeline 102 may be integrated into a motherboard of the device 100. In some examples, one or more components of the display processing pipeline 102 may be may be present on a graphics card of the device 100, such as a graphics card that is installed in a port in a motherboard of the device 100 or a graphics card incorporated within a peripheral device configured to interoperate with the device 100.

The first processing unit 104, the second processing unit 106, and/or the third processing unit 108 may include one or more processors, such as one or more microprocessors, application specific integrated circuits (ASICs), field programmable gate arrays (FPGAs), arithmetic logic units (ALUs), digital signal processors (DSPs), discrete logic, software, hardware, firmware, other equivalent integrated or discrete logic circuitry, or any combinations thereof. In examples where the techniques described herein are implemented partially in software, the software (instructions, code, or the like) may be stored in a suitable, non-transitory computer-readable storage medium accessible by the processing unit. The processing unit may execute the software in hardware using one or more processors to perform the techniques of this disclosure. For example, one or more components of the display processing pipeline 102 may be configured to execute software. The software executable by the first processing unit 104 may be stored in the internal memory 105 and/or the memory 110. The software executable by the second processing unit 106 may be stored in the internal memory 107 and/or the memory 110. The software executable by the third processing unit 108 may be stored in the internal memory 109 and/or the memory 110.

As described herein, a device, such as the device 100, may refer to any device, apparatus, or system configured to perform one or more techniques described herein. For example, a device may be a server, a base station, user equipment, a client device, a station, an access point, a computer (e.g., a personal computer, a desktop computer, a laptop computer, a tablet computer, a computer workstation, or a mainframe computer), an end product, an apparatus, a phone, a smart phone, a server, a video game platform or console, a handheld device (e.g., a portable video game device or a personal digital assistant (PDA)), a wearable computing device (e.g., a smart watch, an augmented reality (AR) device, or a virtual reality (VR) device), a non-wearable device (e.g., a non-wearable AR device or a non-wearable VR device), any AR device, any VR device, a display (e.g., display device), a television, a television set-top box, an intermediate network device, a digital media player, a video streaming device, a content streaming device, an in-car computer, any mobile device, any device configured to generate content, or any device configured to perform one or more techniques described herein. In some examples, the device 100 may be an apparatus. The apparatus may be a processing unit, an SoC, or any device.

As described herein, devices, components, or the like may be described herein as being configured to communicate with each other. For example, one or more components of the display processing pipeline 102 may be configured to communicate with one or more other components of the device 100, such as the display 103, the memory 110, and/or one or more other components of the device 100 (e.g., one or more input devices). One or more components of the display processing pipeline 102 may be configured to communicate with each other. For example, the first processing unit 104 may be communicatively coupled to the second processing unit 106 and/or the third processing unit 108. As another example, the second processing unit 106 may be communicatively coupled to the first processing unit 104 and/or the third processing unit 108. As another example, the third processing unit 108 may be communicatively coupled to the first processing unit 104 and/or the second processing unit 106. As another example, the third processing unit 108 may be communicatively coupled to the display 103.

As described herein, communication may include the communicating of information from a first component to a second component (or from a first device to a second device). The information may, in some examples, be carried in one or more messages. As an example, a first component in communication with a second component may be described as being communicatively coupled to or otherwise with the second component. For example, the first processing unit 104 and the second processing unit 106 may be communicatively coupled. In such an example, the first processing unit 104 may communicate information to the second processing unit 106 and/or receive information from the second processing unit 106. As another example, the third processing unit 108 and the display 103 may be communicatively coupled. In such an example, the third processing unit 108 may communicate information (e.g., content and/or one or more instructions) to the display 103, and the display 103 may receive the information communicated by the display 103.

In some examples, the term "communicatively coupled" may refer to a communication connection, which may be direct or indirect. A communication connection may be wired and/or wireless. A wired connection may refer to a conductive path, a trace, or a physical medium (excluding wireless physical mediums) over which information may travel. A conductive path may refer to any conductor of any length, such as a conductive pad, a conductive via, a conductive plane, a conductive trace, or any conductive medium. A direct communication connection may refer to a connection in which no intermediary component resides between the two communicatively coupled components. An indirect communication connection may refer to a connection in which at least one intermediary component resides between the two communicatively coupled components. In some examples, a communication connection may enable the communication of information (e.g., the output of information, the transmission of information, the reception of information, or the like). In some examples, the term "communicatively coupled" may refer to a temporary, intermittent, or permanent communication connection.

Any device or component described herein may be configured to operate in accordance with one or more communication protocols. For example, a first and second component may be communicatively coupled over a connection. The connection may be compliant or otherwise be in accordance with a communication protocol. As used herein, the term "communication protocol" may refer to any communication protocol, such as a communication protocol compliant with a communication standard or the like. As an example, a communication protocol may include the Display Serial Interface (DSI) protocol. DSI may enable communication between the third processing unit 108 and the display 103 over a connection, such as a bus.

The display 103 may be configured to operate in one or more modes of operation. In some examples, the third processing unit 108 may be configured to provide one or more instructions to the display 103 that cause the display 103 to configure itself into a select operating mode.

For example, the display 103 may be configured to operate in a self-refresh mode in which the memory 136 is used to store all received content. For example, when the display 103 is configured to operate in the self-refresh mode, the third processing unit 108 may be configured to provide content and one or more instructions to the display 103. The display 103 may be configured to receive the content and store the received content in the memory 136 based on the one or more instructions. The processing unit 134 is configured to refresh the content presented on the display 103 by reading content stored in the memory 136. Otherwise described, when the display 103 is configured to operate in the self-refresh mode, the display 103 uses the memory 136 to store received content and reads stored content from the memory 136 when refreshing the display 103. As described herein, refreshing the display 103 may refer to updating the display 103 with content. When the display 103 is configured to operate in the self-refresh mode, the processing unit 134 controls the refresh timing of the display. For example, the processing unit 134 controls the refresh rate of content presented on the display 103. The self-refresh mode may be used when the content rate (i.e., the rate at which content is provided to or otherwise ready for the third processing unit 108) is less than the refresh rate of the display 103 to avoid repeated framebuffer pixel transfer by the third processing unit 108 (e.g., avoid having the third processing unit 108 from providing the same content two or more times). For example, the second processing unit 106 may provide a frame of content at a rate of 30 frames per second (FPS). The third processing unit 108 may be configured to obtain the content generated by the second processing unit 106 by reading the content from the memory location at which the second processing unit 106 stored the content. The refresh rate of the display 103 in this example may be 60 FPS. In this example, because 30 FPS is less than 60 FPS, the self-refresh mode may be more efficient to use than the dumb refresh mode described below.

As another example, the display 103 may be configured to operate in a dumb refresh mode in which the memory 136 is not used to store any received content (i.e., all received content is not stored in the memory 136). Otherwise described, in the dumb refresh mode of operation, the memory 136 is bypassed. In some examples, dumb refresh mode may be referred to as a video mode of operation. In some examples, when the display 103 is configured to operate in the dumb refresh mode, the third processing unit 108 may be configured to provide content and one or more instructions to the display 103. The display 103 may be configured to receive the content and not store the received content in memory based on the one or more instructions. In other examples, when the display 103 is configured to operate in the dumb refresh mode, the third processing unit 108 may be configured to provide content to the display 103 without one or more instructions. The display 103 may be configured to receive the content and not store the received content in the memory 136 because the display 103 is configured in the dumb refresh mode of operation. When the display 103 is configured to operate in the dumb refresh mode, the third processing unit 108 controls the refresh timing of the display. For example, the third processing unit 108 controls the refresh rate of content presented on the display 103. The dumb refresh mode may be used when the content rate (i.e., the rate at which content is provided to or otherwise ready for the third processing unit 108) is equal to (or closer to) the refresh rate of the display 103 to avoid memory overhead on the display 103 (e.g., write and read operations to respectively store and obtain content stored in the memory 136). For example, the second processing unit 106 may provide a frame of content at a rate of 60 frames per second (FPS). The third processing unit 108 may be configured to obtain the content generated by the second processing unit 106 by reading the content from the memory location at which the second processing unit 106 stored the content. The refresh rate of the display 103 in this example may be 60 FPS. In this example, because the content rate (60 FPS) and the refresh rate (60 FPS) are the same, the dumb refresh mode may be more efficient to use than the self-refresh mode described above.

Configuring the display 103 in either the self-refresh mode or the dumb refresh mode is less than optimal for examples in which the content destined for display includes first content generated at a first content rate and second content generated at a second content rate. The first content rate is greater than the second content rate in this example, such as 60 FPS and 30 FPS, respectively. In such an example, using the self-refresh mode or the dumb refresh mode is less than optimal. For example, if the display 103 were configured to operate in the self-refresh mode in this example, the first content and the second content destined for display would be stored in the memory 136 resulting in memory overhead on the display 103 for the first content of its higher content rate. As another example, if the display 103 were configured to operate in the dumb refresh mode in this example, the first content and the second content destined for display would not be stored in the memory 136 resulting in repeated framebuffer pixel transfer for the second content by the third processing unit 108. The techniques described herein pertaining to the hybrid refresh mode of operation enable more efficient consumption of resources (e.g., processing resources and memory resources) by the third processing unit 108 and the display 103. While the example above pertains to the first content rate being different from the second content rate, the techniques described herein may be used when the first content is the same as or different from the second content rate. For example, even if the first and second content rates are the same, the techniques described herein pertaining to the hybrid refresh mode of operation enable more control of how resources (e.g., processing resources and memory resources) of the third processing unit 108 and/or the display 103 are consumed.

In accordance with the techniques described herein, the display 103 may be configured to operate in a hybrid refresh mode in which the memory 136 is used to store some received content and is not used to store other received content. For example, content destined for display may include first content generated at a first content rate and second content generated at a second content rate. The first content rate corresponds to the rate at which the first content is provided to (e.g., by the component generating or providing the first content) or otherwise ready for the third processing unit 108. Similarly, the second content rate corresponds to the rate at which the second content is provided to (e.g., by the component generating or providing the second content) or otherwise ready for the third processing unit 108. The first content rate may be different than (e.g., greater than) the second content rate in some examples. In other examples, the first content rate may be the same as the second content rate.

When the display 103 is configured to operate in the hybrid refresh mode, the third processing unit 108 may be configured to cause a first region of the display 103 to be refreshed without using (e.g., bypassing) the memory 136 and a second region of the display 103 to be refreshed using the memory 136 of the display 103. The first content may be associated with the first region of the display 103 and the second content may be associated with the second region of the display 103. The third processing unit 108 may be configured to provide the first content to the display 103 with one or more instructions or without one or more instructions. Based on the one or more instructions or based on the absence of one or more instructions, the processing unit 134 of the display 103 may be configured to not store the first content in the memory 136. Instead, the processing unit 134 may be configured to provide the first content directly to the first region of the display resulting in a refresh of the first region of the display 103 with the first content. Since the first content is not stored in the memory 136, the first content may not be re-used by the display 103 on a subsequent refresh. The third processing unit 108 may be configured to provide the second content to the display 103 with one or more instructions. Based on the one or more instructions, the processing unit 134 of the display 103 may be configured to store the second content in the memory 136. To refresh the second region of the display 103 with the second content, the processing unit 134 may be configured to read the second content from the memory 136 and provide the second content to the second region of the display 103 resulting in a refresh of the second region of the display 103 with the second content. Since the second content is stored in the memory 136, the second content may be re-used by the display 103 on a subsequent refresh. For example, after providing the second content to the display 103, the third processing unit 108 may be configured to provide one or more instructions to the display 103 resulting in the re-use of the second content stored in the memory 136 to refresh the second region of the display 103 one or more times. In some examples, the second content stored in the memory 136 may be re-used once, twice, or any number of times.

The display 103 may include a plurality of regions that may be refreshed with content. The display 103 may be configured to display a single frame of content. The frame of content may include regions of content with each respective region of content of the frame having a respective content rate. Each region of the plurality of regions of the display 103 may be associated with respective content having a respective content rate. For example, a frame of content may include one or more high FPS regions of content and one or more low FPS regions of content. A high FPS region of the display 103 may be a region of the display 103 associated with a region of content in the frame having a first content rate and a low FPS region of the display 103 may be a region of the display 103 associated with a region of content in the frame having a second content rate. The first content rate is higher than the second content rate in this example. A region of the display 103 associated with a region of content in the frame may be described as being a region of the display 103 destined to display the region of content in the frame.

In accordance with the hybrid refresh mode, the third processing unit 108 may be configured to cause the display 103 to refresh the one or more high FPS regions of the display 103 without using the memory 136 (e.g., content destined for the one or more high FPS regions is not stored in the memory 136), and cause the display 103 to refresh the one or more low FPS regions of the display 103 using the memory 136 (e.g., content destined for the one or more low FPS regions is stored in the memory 136). The third processing unit 108 may control the refresh timing of the display 103. For example, the third processing unit 108 may be configured to instruct the display 103 to refresh the display using (1) content received from the third processing unit 108 but not stored in the memory 136 of the display 103 for the one or more high FPS regions, and (2) content stored in the memory 136 of the display 103 for the one or more low FPS regions. In some examples, the third processing unit 108 may be configured to control the refresh timing of the display 103 by controlling when each line of the display 103 is refreshed or otherwise updated with content.

In some examples, the third processing unit 108 may be configured to determine which content that is to be stored or not to be stored in the memory 136 of the display 103 based on update trends. For example, the third processing unit 108 may be configured to compare two or more frames of content to determine which regions of the two or more frames change and/or do not change (or change less compared to the regions that change). Based on the comparison, the third processing unit 108 may be configured to determine that the regions of content corresponding to the regions that change are not to be stored in the memory 136 when provided to the display 103, determine that the regions of content corresponding to the regions that do not change (or change less compared to the regions that change) are to be stored in the memory 136 when provided to the display 103.

In some examples, the third processing unit 108 may be configured to provide a write instruction that causes the processing unit 134 to write received content corresponding to the received content into the memory 136 and refresh the regions corresponding to the received content with the received content. Since the memory 136 is being accessed for writing received content thereto, the received content is understood as corresponding to content having the second content rate instead of the first content rate. The write instruction may be part of a DSI display command set (DCS). In some examples, the write instruction is a write-read instruction that causes the processing unit 134 to write received content into the memory 136 and read the received content stored in the memory 136 for refreshing the corresponding regions of the display 103. In other examples, the write instruction causes the processing unit 134 to write received content into the memory 136 and simultaneously (e.g., in parallel) refresh the corresponding regions of the display 103 with the received content.

In some examples, the third processing unit 108 may be configured to provide a re-use read instruction that causes the processing unit 134 to read a current line of content from the memory 136 for re-use. Since the memory 136 is being accessed, the line being read from the memory 136 for re-use is understood as corresponding to content having the second content rate instead of the first content rate. The re-use read instruction may be part of a DSI DCS. In some examples, the third processing unit 108 may be configured to provide a re-use read instruction for each line of content to be read from the memory 136.

Figure 2:
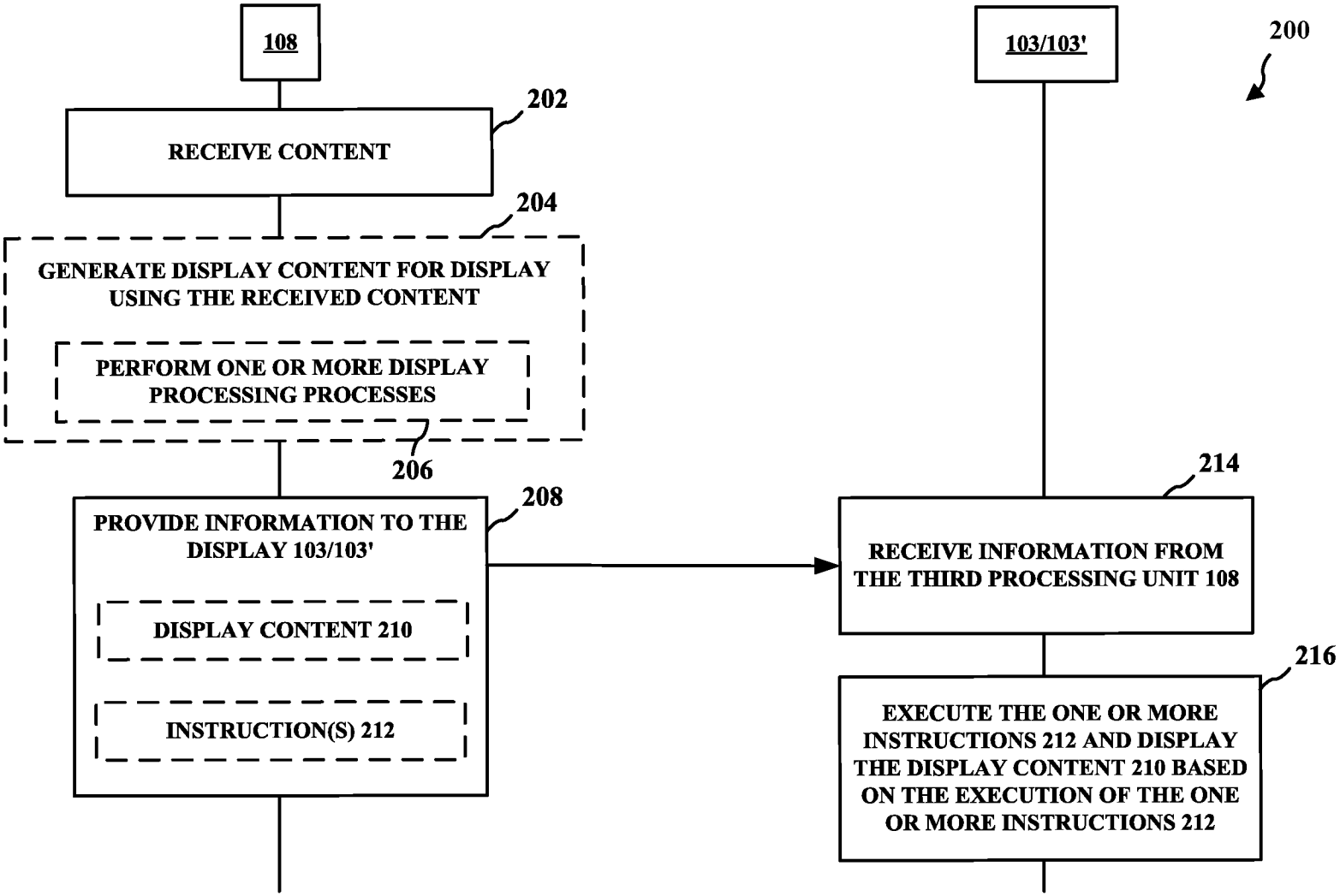
FIG. 2 illustrates an example flow diagram in accordance with the techniques described herein.

FIG. 2 illustrates an example flow diagram 200 in accordance with the techniques described herein with respect to the hybrid mode of operation of the display 103. In other examples, one or more techniques described herein may be added to the flow diagram 200 and/or one or more techniques depicted in the flow diagram may be removed. One or more blocks shown in FIG. 2 may be performed in parallel.

Figure 3A:
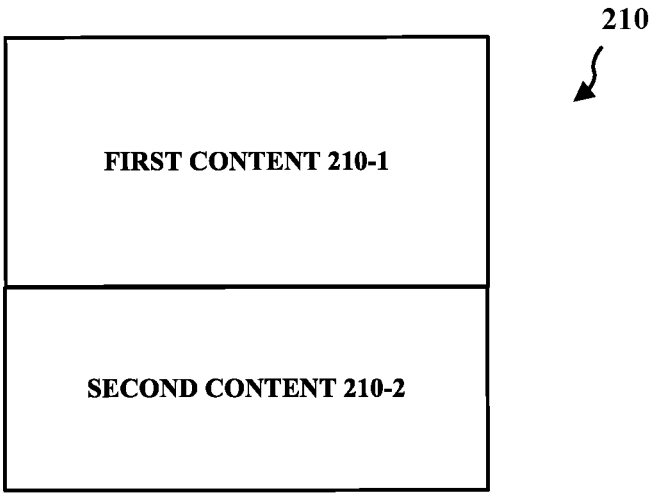
FIG. 3A illustrates an example of display content in accordance with one or more techniques of this disclosure.
Figure 3B:
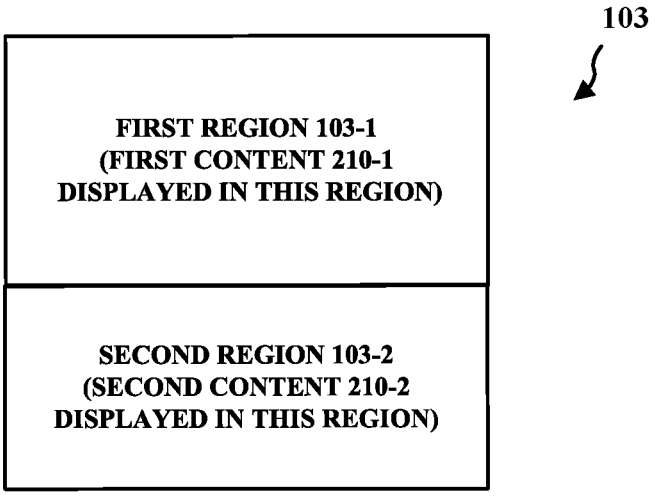
FIG. 3B illustrates an example of a display refreshed with first content and second content in accordance with one or more techniques of this disclosure.

In the example of FIG. 2, at block 202, the third processing unit 108 may be configured to receive content. At block 204, the third processing unit 108 may be configured to generate display content for display using the received content. To generate display content, the third processing unit 108 may be configured to perform one or more display processing processes 206 (e.g., composition display processes, such as blending, rotation, or any other composition display process) on the received content read. For example, the received content may include one or more layers or frames that may be blended together into a frame for display, which may be referred to as display content. The display content may include a plurality of regions. For example, FIG. 3A illustrates an example of display content 210. Display content 210 is shown as having two regions of content. The first content region includes the first content 210-1 and the second content region includes the second content 210-2. The first content 210-1 may have a first content rate and the second content 210-2 may have a second content rate. The first and second content rates may be the same or different. In the example of FIGS. 2, 3A, and 3B, the first content rate is greater than the second content rate.

Returning to FIG. 2, at block 208, the third processing unit 108 may be configured to provide information to the display 103. In some examples, the information may include display content (e.g., display content 210) and one or more instructions corresponding to the display content being provided (e.g., one or more instructions 212 corresponding to the display content 210). In other examples, the information may include one or more instructions (e.g., one or more re-use read instructions) without corresponding display content because the display content was previously provided to the display 103 by the third processing unit 108.

At block 214, the display 103 may be configured to receive the information provided by the third processing unit 108. At block 216, the processing unit 134 of the display 103 may be configured to execute the one or more instructions received from the third processing unit 108 to cause the display of display content on the display 103. For example, referring to the example of display content 210 shown in FIG. 3A, one or more instructions may correspond to the first content 210-1 and one or more instructions may correspond to the second content 210-2.

In an example where the information received by the display 103 includes the first content 210-1 and the second content 210-2, the information also includes one or more instructions corresponding to the first content 210-1 and one or more instructions corresponding to the second content 210-2. Upon execution of the one or more instructions corresponding to the first content 210-1 by the processing unit 134, the processing unit 134 may cause a first region of the display 103 to be refreshed without using the memory 136. Without using the memory 136 may refer to bypassing the memory 136 or otherwise not storing the first content 210-1 into the memory 136. Upon execution of the one or more instructions corresponding to the second content 210-2 by the processing unit 134, the processing unit 134 may cause a second region of the display 103 to be refreshed using the memory 136. Using the memory 136 in this example may refer to storing the second content 210-2 into the memory 136. FIG. 3B illustrates an example of the display 103 refreshed with the first content 210-1 and the second content 210-2. For example, the first content 210-1 is shown as being displayed in the first region 103-1 and the second content 210-2 is shown as being displayed in the second region 103-2. The first content 210-1 is thus associated with the first region 103-1 of the display 103 and the second content 210-2 is thus associated with the second region 103-2 of the display 103.

In an example where the information received by the display 103 includes the first content 210-1 and one or more instructions corresponding to the second content 210-2, the information also includes one or more instructions corresponding to the first content 210-1. The one or more instructions corresponding to the second content 210-2 may be one or more re-use read instructions. Upon execution of the one or more instructions corresponding to the first content 210-1 by the processing unit 134, the processing unit 134 may cause a first region of the display 103 to be refreshed without using the memory 136. Without using the memory 136 may refer to bypassing the memory 136 or otherwise not storing the first content 210-1 into the memory 136. Upon execution of the one or more instructions corresponding to the second content 210-2 by the processing unit 134, the processing unit 134 may cause a second region of the display 103 to be refreshed using the memory 136. Using the memory 136 in this example may refer to reading the second content 210-2 stored in the memory 136 for re-use. The second content 210-2 may be stored in the memory 136 because it was initially provided to the display 103 by the third processing unit 108 for a previous frame. The refresh of display 103 in this example may be a subsequent frame. The processing unit 134 may be configured to cause the second region of the display 103 to be refreshed with the second content 210-1 read from the memory 136. FIG. 3B illustrates an example of the display 103 refreshed with the first content 210-1 and the second content 210-2. For example, the first content 210-1 is shown as being displayed in the first region 103-1 and the second content 210-2 is shown as being displayed in the second region 103-2. The first content 210-1 is thus associated with the first region 103-1 of the display 103 and the second content 210-2 is thus associated with the second region 103-2 of the display 103.

Figure 4:
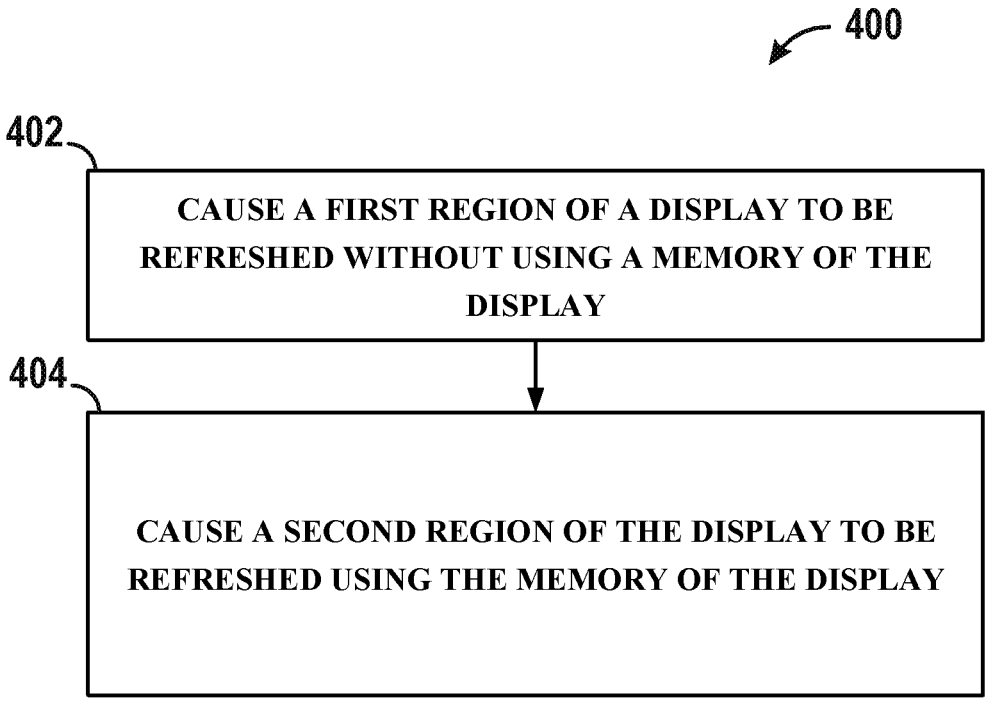
FIG. 4 illustrates an example flowchart of an example method in accordance with one or more techniques of this disclosure.

FIG. 4 illustrates an example flowchart 400 of a method in accordance with one or more techniques of this disclosure. The method may be performed by the third processing unit 108. In some examples, the method illustrated in flowchart 400 may include one or more functions described herein that are not illustrated in FIG. 4, and/or may exclude one or more illustrated functions.

At block 402, the third processing unit 108 may be configured to cause a first region of a display (e.g., display 103) to be refreshed without using a memory of the display. At block 404, the third processing unit 108 may be configured to cause a second region of the display to be refreshed using the memory of the display. In some examples, first content may be associated with the first region and second content may be associated with the second region. The first content may include first pixel data for one or more lines of the first region. The second content may include second pixel data for one or more lines of the second region.

In some examples, the third processing unit 108 may be configured to receive the first content at a first content rate and receive the second content at a second content rate. The first content rate may be greater than the second content rate. For example, the first content may be high FPS content and the second content may be low FPS content.

In some examples, the third processing unit 108 may be configured to determine the first region of the display is associated with the first content rate and the second region of the display is associated with the second content rate. In such examples, to cause the first region of the display to be refreshed without using the memory of the display, the third processing unit 108 may be configured to cause the first region of the display to be refreshed without using the memory of the display based on the determination that the first region of the display is associated with the first content rate. Similarly, to cause the second region of the display to be refreshed using the memory of the display, the third processing unit 108 may be configured to cause the second region of the display to be refreshed using the memory of the display based on the determination that the second region of the display is associated with the second content rate.

In some examples, to cause the first region of the display to be refreshed without using the memory of the display, the third processing unit 108 may be configured to cause the first region of the display to be refreshed at a first refresh rate without using the memory of the display. To cause the second region of the display to be refreshed using the memory of the display, the third processing unit may be configured to cause the second region of the display to be refreshed at a second refresh rate using the memory of the display. In some examples, the first refresh rate may equal the second refresh rate. In other examples, the first refresh rate and the second refresh rate may be different.

In some examples, to cause the first region of the display to be refreshed without using the memory of the display, the third processing unit 108 may be configured to provide the first content to the display without instruction to store the first content in the memory of the display. To cause the second region of the display to be refreshed using the memory of the display, the third processing unit 108 may be configured to provide the second content to the display with instruction to store the second content in the memory of the display. In another example, to cause the second region of the display to be refreshed using the memory of the display, the third processing unit 108 may be configured to provide one or more instructions to the display. The one or more instructions may, when executed by a processing unit of the display, cause the processing unit of the display to read the second content from a memory of the display.

In some examples, the third processing unit 108 may be configured to control timing associated with the first refresh rate and the second refresh rate. For example, the third processing unit 108 may be configured to control when the display is to refresh respective regions of the display with content.

In accordance with this disclosure, the term "or" may be interrupted as "and/or" where context does not dictate otherwise. Additionally, while phrases such as "one or more" or "at least one" or the like may have been used for some features disclosed herein but not others; the features for which such language was not used may be interpreted to have such a meaning implied where context does not dictate otherwise.

In one or more examples, the functions described herein may be implemented in hardware, software, firmware, or any combination thereof. For example, although the term "processing unit" has been used throughout this disclosure, it is understood that such processing units may be implemented in hardware, software, firmware, or any combination thereof. If any function, processing unit, technique described herein, or other module is implemented in software, the function, processing unit, technique described herein, or other module may be stored on or transmitted over as one or more instructions or code on a computer-readable medium. Computer-readable media may include computer data storage media or communication media including any medium that facilitates transfer of a computer program from one place to another. In this manner, computer-readable media generally may correspond to (1) tangible computer-readable storage media, which is non-transitory or (2) a communication medium such as a signal or carrier wave. Data storage media may be any available media that can be accessed by one or more computers or one or more processors to retrieve instructions, code and/or data structures for implementation of the techniques described in this disclosure. By way of example, and not limitation, such computer-readable media can comprise RAM, ROM, EEPROM, CD-ROM or other optical disk storage, magnetic disk storage or other magnetic storage devices. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media. A computer program product may include a computer-readable medium.

The code may be executed by one or more processors, such as one or more digital signal processors (DSPs), general purpose microprocessors, application specific integrated circuits (ASICs), arithmetic logic units (ALUs), field programmable logic arrays (FPGAs), or other equivalent integrated or discrete logic circuitry. Accordingly, the term "processor," as used herein may refer to any of the foregoing structure or any other structure suitable for implementation of the techniques described herein. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules or units are described in this disclosure to emphasize functional aspects of devices configured to perform the disclosed techniques, but do not necessarily require realization by different hardware units. Rather, as described above, various units may be combined in any hardware unit or provided by a collection of interoperative hardware units, including one or more processors as described above, in conjunction with suitable software and/or firmware.

Various examples have been described. These and other examples are within the scope of the following claims.

What is claimed is:

1. A method comprising:

causing, by a display processor, a first region of a display to be refreshed without using a memory of the display by providing a first content to the display without instruction to store the first content in the memory of the display;

causing, by the display processor, a second region of the display to be refreshed using the memory of the display by providing a second content to the display with instruction to store the second content in the memory of the display; and receiving, by the display processor, the first content at a first content rate and the second content at a second content rate, wherein the first content is associated with the first region and the second content is associated with the second region.

2. The method of claim 1, wherein the first content rate is greater than the second content rate.

3. The method of claim 2, wherein the first content is high frames per second (FPS) content and the second content is low FPS content.

4. The method of claim 2, further comprising:

determining, by the display processor, the first region of the display is associated with the first content rate and the second region of the display is associated with the second content rate, and wherein:

causing the first region of the display to be refreshed without using the memory of the display comprises causing the first region of the display to be refreshed without using the memory of the display based on the determination that the first region of the display is associated with the first content rate, and causing the second region of the display to be refreshed using the memory of the display comprises causing the second region of the display to be refreshed using the memory of the display based on the determination that the second region of the display is associated with the second content rate.

5. The method of claim 1, wherein causing the first region of the display to be refreshed without using the memory of the display comprises:

causing the first region of the display to be refreshed at a first refresh rate without using the memory of the display.

6. The method of claim 5, wherein causing the second region of the display to be refreshed using the memory of the display comprises:

causing the second region of the display to be refreshed at a second refresh rate using the memory of the display.

7. The method of claim 6, wherein the first refresh rate equals the second refresh rate.

8. The method of claim 6, wherein the first refresh rate and the second refresh rate are different.

9. The method of claim 6, further comprising:

controlling, by the display processor, timing associated with the first refresh rate and the second refresh rate.

10. The method of claim 1, wherein the first content includes first pixel data for one or more lines of the first region, and wherein the second content includes second pixel data for one or more lines of the second region.

11. The method of claim 1, wherein:

causing the first region of the display to be refreshed without using the memory of the display comprises providing the first content to the display without instruction to store the first content in the memory of the display; and causing the second region of the display to be refreshed using the memory of the display comprises providing an instruction to the display, wherein the instruction, when executed by a processing unit of the display, causes the processing unit of the display to read the second content from the memory of the display.

12. An apparatus for display processing, comprising:

a memory; and at least one processor coupled to the memory and configured to:

cause, by a display processor, a first region of a display to be refreshed without using a memory of the display by providing a first content to the display without instruction to store the first content in the memory of the display;

cause, by the display processor, a second region of the display to be refreshed using the memory of the display by providing a second content to the display with instruction to store the second content in the memory of the display; and receive, by the display processor, first content at a first content rate and second content at a second content rate, wherein the first content is associated with the first region and the second content is associated with the second region.

13. The apparatus of claim 12, wherein the first content rate is greater than the second content rate.

14. The apparatus of claim 13, wherein the first content is high frames per second (FPS) content and the second content is low FPS content.

15. The apparatus of claim 13, wherein the unit display processor is further configured to:

determine, by the display processor, the first region of the display is associated with the first content rate and the second region of the display is associated with the second content rate, and wherein:

to cause the first region of the display to be refreshed without using the memory of the display, the display processor is configured to cause the first region of the display to be refreshed without using the memory of the display based on the determination that the first region of the display is associated with the first content rate, and to cause the second region of the display to be refreshed using the memory of the display, the display processor is configured to cause the second region of the display to be refreshed using the memory of the display based on the determination that the second region of the display is associated with the second content rate.

16. The apparatus of claim 12, wherein to cause the first region of the display to be refreshed without using the memory of the display, the display processor is configured to:

cause the first region of the display to be refreshed at a first refresh rate without using the memory of the display.

17. The apparatus of claim 16, wherein to cause the second region of the display to be refreshed using the memory of the display, the display processor is configured to:

cause the second region of the display to be refreshed at a second refresh rate using the memory of the display.

18. The apparatus of claim 17, wherein the first refresh rate equals the second refresh rate.

19. The apparatus of claim 17, wherein the first refresh rate and the second refresh rate are different.

20. The apparatus of claim 17, wherein the display processor is further configured to:

control, by the display processor, timing associated with the first refresh rate and the second refresh rate.

21. The apparatus of claim 12, wherein the first content includes first pixel data for one or more lines of the first region, and wherein the second content includes second pixel data for one or more lines of the second region.

22. The apparatus of claim 12, wherein:

to cause the first region of the display to be refreshed without using the memory of the display, the display processor is configured to provide the first content to the display without instruction to store the first content in the memory of the display; and to cause the second region of the display to be refreshed using the memory of the display, the display processor is configured to provide an instruction to the display, wherein the instruction, when executed by a processing unit of the display, causes the processing unit of the display to read the second content from the memory of the display.

23. An apparatus comprising:

means for causing a first region of a display to be refreshed without using a memory of the display by providing a first content to the display without instruction to store the first content in the memory of the display;

means for causing a second region of the display to be refreshed using the memory of the display by providing a second content to the display with instruction to store the second content in the memory of the display; and means for receiving first content at a first content rate and second content at a second content rate, wherein the first content is associated with the first region and the second content is associated with the second region.

24. A non-transitory computer readable medium having code stored thereon that, when executed by a processing unit, causes the processing unit to:

cause, by a display processor, a first region of a display to be refreshed without using a memory of the display by providing a first content to the display without instruction to store the first content in the memory of the display;

cause, by the display processor, a second region of the display to be refreshed using the memory of the display by providing a second content to the display with instruction to store the second content in the memory of the display; and receive, by the display processor, first content at a first content rate and second content at a second content rate, wherein the first content is associated with the first region and the second content is associated with the second region.

* * * * *